United States Patent [19]

Mahrt et al.

[11] 4,107,820

[45] Aug. 22, 1978

[54] DEVICE FOR OPENING AND MIXING FIBER BALES

[75] Inventors: Günter Mahrt, Oberstimm; Georg Goldammer, Gaimersheim, both of Fed. Rep. of Germany

[73] Assignee: Schubert & Salzer, Ingolstadt, Fed. Rep. of Germany

[21] Appl. No.: 802,818

[22] Filed: Jun. 2, 1977

[30] Foreign Application Priority Data

Jun. 15, 1976 [DE] Fed. Rep. of Germany ..... 2626648

[51] Int. Cl.[2] ..... D01G 13/00

[52] U.S. Cl. ..... 19/81; 19/145.5

[58] Field of Search ..... 19/80 R, 81, 145.5; 241/101 A

[56] References Cited

U.S. PATENT DOCUMENTS

| | | | |
|---|---|---|---|
| 3,777,908 | 12/1973 | Keller | 19/145.5 X |
| 3,797,072 | 3/1974 | Goldammer | 19/81 |
| 3,806,990 | 4/1974 | Goldammer et al. | 19/145.5 |

*Primary Examiner*—Dorsey Newton

*Attorney, Agent, or Firm*—Bailey, Dority & Flint

[57] ABSTRACT

A device for opening and mixing fibers according to a predetermined mixture ratio with a pincer-like gripper device. A carriage transports the pincer-like gripper pass bales of different fibers so that the pincer-like gripper device can remove fibers from said bales according to desired ratios for making up a predetermined mixture ratio. The width that the gripper device is opened is variable so that small amounts of fibers can be picked up from the bales when a small ratio is desired and when a large ratio is desired for making up the mixture ratio, the grippers can be opened wider for making the device more efficient.

9 Claims, 12 Drawing Figures

Fig.5
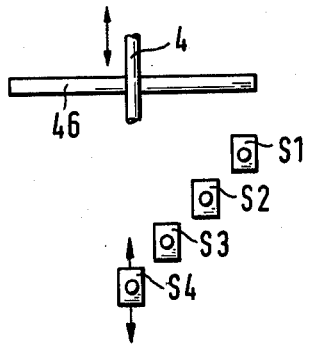
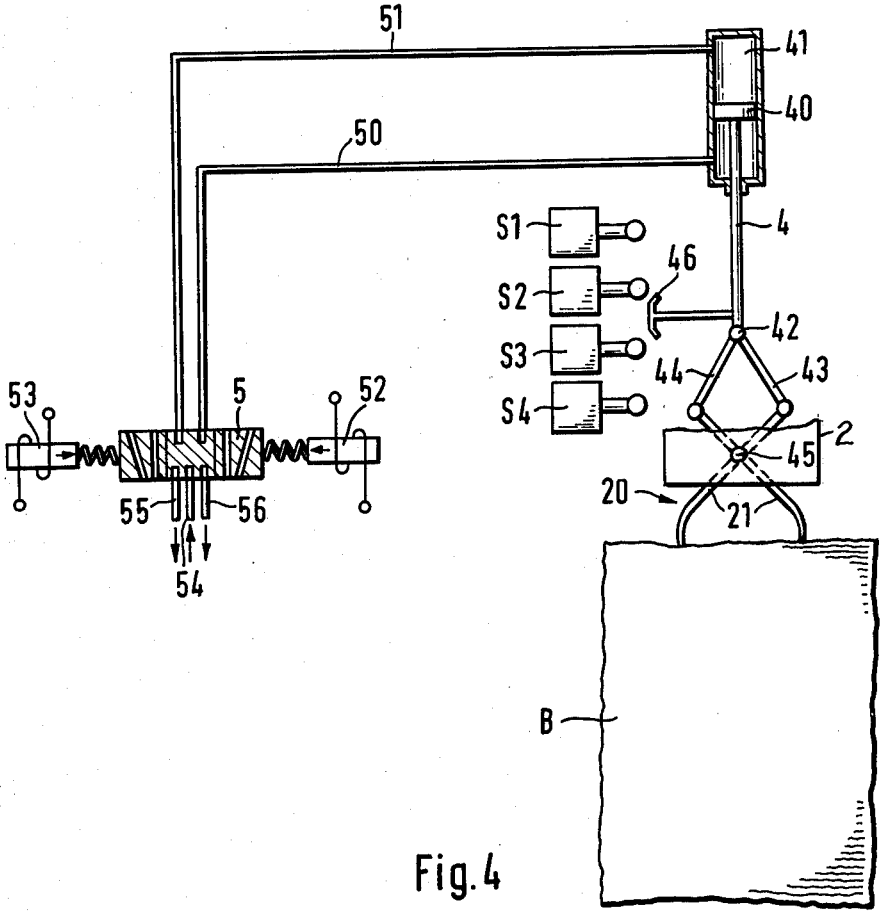
Fig.4

DEVICE FOR OPENING AND MIXING FIBER BALES

BACKGROUND OF THE INVENTION

It is known to take up fibrous material successively from bales of fibers of varying origins (U.S. Pat. No. 3,443,285) in quantities according to a previously determined mixture ratio by means of pincer-like grippers whereby fiber bales of the same type of fiber are suitably placed in fiber collection points (U.S. Pat. No. 3,577,599). This has the result that small amounts of fibers are mixed in a predetermined ratio during the taking up process. However, this may have the result that the mixture ratio of one type of fiber is very small, whereas the proportion of the other type or types of fiber(s) may be relatively large. In order to keep as near as possible to the small quantity of the mixture ratio, it is essential to keep the fiber quantity picked up by the gripper as small as possible. The pincer-like gripper is, therefore, set to a correspondingly small opening width. This, however, leads to a drop in productivity in the take-up device since only a small quantity of fibrous material is also picked up from the bales of the fiber collection points containing the types of fibers with the relatively large mixture ratio. Therefore, the grippers have to be brought into engagement with the bales more frequently until the correct proportion of the particular predetermined ratio has been achieved.

SUMMARY OF THE INVENTION

The invention pertains to a device for opening and mixing fibers according to predetermined mixture ratios with a pincer-like gripper device which picks off fibers from bales of different fibers and deposits the fibers at another location. The device includes drive means for effecting the opening and and closing of the pincer-like gripper device for removing fibers from the bales of different fibers. Means such as limit switches are provided for limiting the opening of the pincer-like gripper device to a predetermined width for removing fibers constituting the smallest ratio of the desired mixture ratio when picking off fibers from one of the bales. Means is also provided for limiting the opening of the pincer-like gripper device to a second predetermined width for removing fibers from another bale of different fibers constituting a larger ratio of the mixture ratios. The second width of opening of the pincer-like gripper device and normally all subsequent openings are greater than the first width so that the individual pickoffs from the bale calling for a larger ratio is greater than the individual pickoffs from the bale of the first type of fibers.

While throughout the specification and claims reference is made to different types of fibers, this is to include fibers of different sizes, qualities, and/or different types. By selectively varying the width that the gripper device is opened in picking up the fibers, small amounts of fibers can be picked off of bales calling for the smallest ratio and large amounts of fibers can be picked off of bales calling for larger ratios thus making the device a much more efficient bale opening and fiber mixing mechanism.

Accordingly, it is an object of the present invention to provide a device for opening and mixing bales of fibers by means of a pincer-like gripper which picks up fibers from bales in amounts corresponding to the desired mixture ratio of the fiber bales.

Another important object of the present invention is to provide a device for mixing and opening bales of fibers in a simple and efficient manner.

These and other objects and advantages of the invention will become apparent upon reference to the following specification, attendant claims, and drawings.

BRIEF DESCRIPTION OF THE DRAWING

FIG. 4 is a schematic view illustrating a gripper device with drive means forming part of the fiber pickoff and mixing device shown in FIG. 1.

FIG. 5 is a schematic representation of the limit switches utilized in FIG. 4.

DESCRIPTION OF A PREFERRED EMBODIMENT

Figure 1:
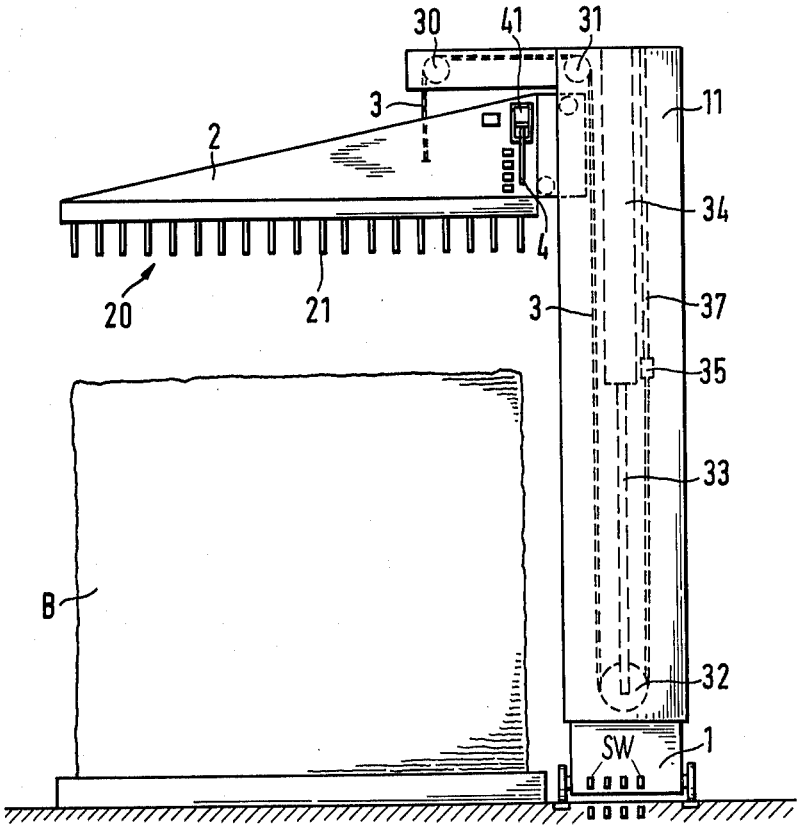
FIG. 1 is an elevational view illustrating a device for opening fiber bales with a gripper constructed in accordance with the present invention.
Figure 2:
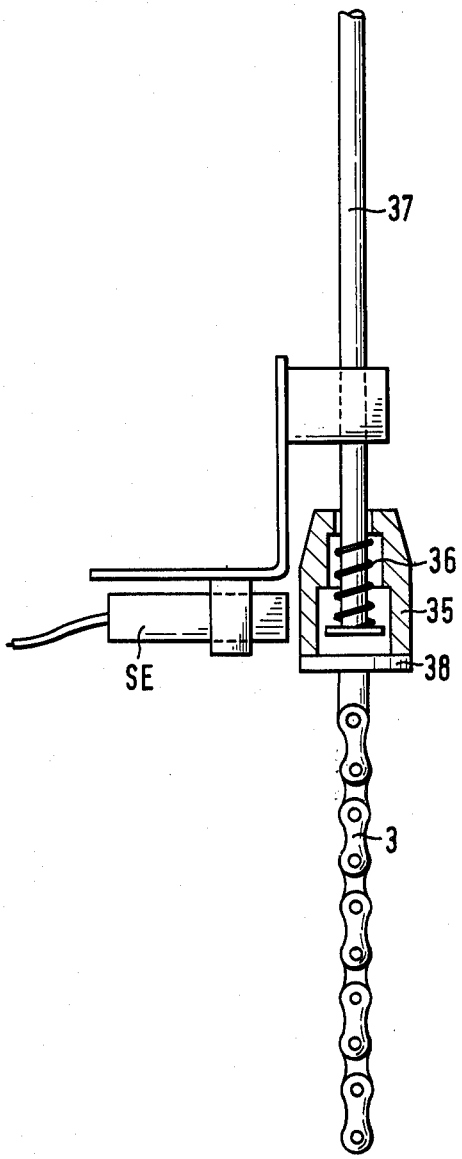
FIG. 2 is an enlarged elevational view illustrating a sensor utilized in the device.
Figure 3:
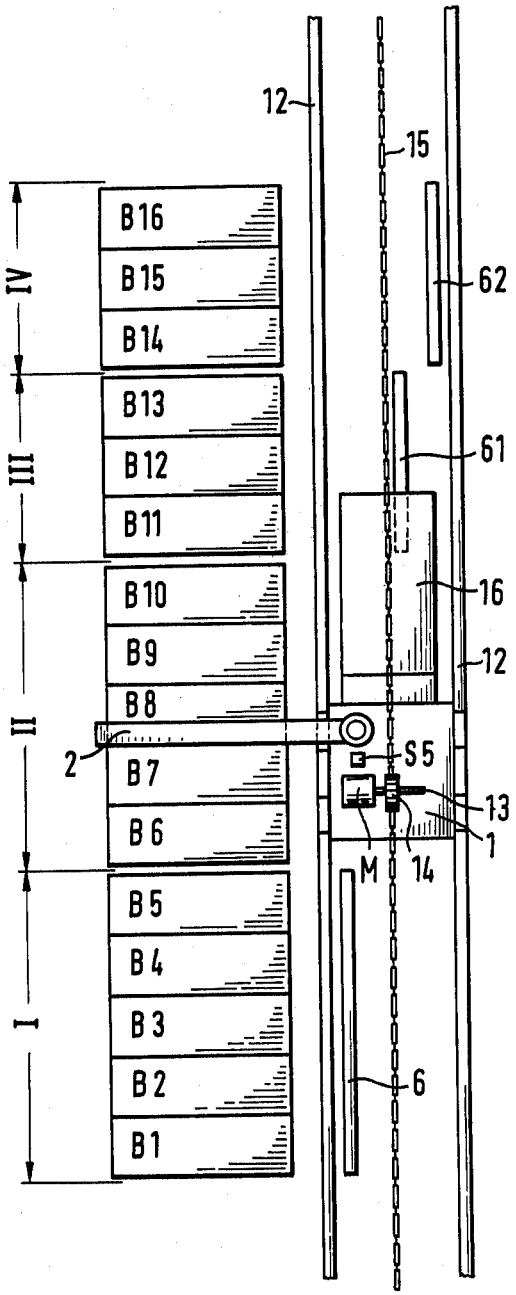
FIG. 3 is a plan view with parts removed illustrating the device constructed in accordance with the present invention traveling along a row of bales from which fibers are to be picked off.

Referring in more detail to the drawings, there is illustrated a support column 11 mounted on a carriage 1. The column 11 supports a gripper arm 2 with gripper fingers 21 arranged in pairs which are together referred to as gripper device 20 and which open and close in a pincer-like manner (FIG. 1). The gripper arm 2 moves in a vertical direction so that the gripper device 20 may engage a bale B and be lifted up again by the same. The vertical movement of the gripper arm 2 with the gripper device 20 takes place via a traction means, for example, a chain 3 which is secured to the gripper arm 2 and supported by guide rollers 30 and 31. The chain 3 is engaged by a sprocket 32 fixed to a piston rod 33. The piston of the piston rod 33 is housed in a cylinder 34 and is driven pneumatically or hydraulically. The other end of the chain 3 is secured in a housing 35 which against the force of a spring 36 moves along a rod 37 fixed to the support column 11 when, during insertion of the gripper device 20 into the fiber bale B, the tension in the chain 3 is released (FIG. 2). A switch SE, which is adjustable in a vertical direction, is fixed near the housing 35 which has a metal base plate 38. Sensors of this type, which through the chain tension determine the depth of insertion of the gripper device into the bale, are known and the present one is shown only as an example. The take-up device travels on rails 12 along a row of fiber bales B1, B2 . . . B16 (FIG. 3). It is driven by a reversible drive motor M with a drive shaft 13 to which is fitted a sprocket 14 which engages a chain 15 extending parallel to the rails 12. In the present example, the fiber bales B1, B2 . . . B16 make up four fiber collection points I, II, III and IV. Each one of these fiber collection points contain specific types of fiber which have to be mixed according to predetermined mixture ratios.

The quantities corresponding to these mixture ratios are taken by the gripper device 20 one after another from the individual fiber collection points I, II, III and IV in a known manner according to a predetermined program and deposited in a container 16. The container is fixed to the support column 11 and also serves as a weighing machine. For this purpose, the gripper arm 2 and gripper device 20 are designed to swivel from a position above the fiber bales to a position above the container 16.

The pincer-like opening and closing of the gripper fingers 21, forming the gripper device 20, is effected according to FIG. 4 by a piston rod 4 whose piston 40 is housed in a cylinder 41 and which is driven pneumatically or hydraulically. The drive means, which is provided in the gripper arm 2, is connected with the gripper device 20 in such a way that the piston rod 4 engages a rod 42 on which are provided tongues 43 and 44. The tongues 43 and 44 are linked to the gripper fingers 21 which, in turn, are swivelably mounted on a spindle 45 which is connected to the gripper arm 2 and which extends the length of the same. The compressed air for the cylinder 41 is supplied alternately by two pipes 50 and 51 and is regulated by a magnetic valve 5 with electromagnets 52 and 53. The magnetic valve 5 is connected via a pipe 54 with a source of compressed air (not shown). Pipes 55 and 56 lead from the magnetic valve 5 to the atmosphere.

According to the invention, the drive means for opening and closing the gripper device 20, in this case the piston rod 4, is provided with limit means which limit the downwards movement of the piston rod 4, thereby fixing the opening width of the gripper device 20 or gripper fingers 21. Corresponding to the four fiber supply points I, II, III and IV, there are provided four limit switches S1, S2, S3 and S4 which are actuated by a control cam 46 fixed to the piston rod 4. The limit switches S1, S2, S3 and S4 are mounted side by side in an offset manner in the vicinity of the piston rod 4, as shown in FIG. 5. The double arrow shows that the limit switch S4 can be moved up and down in a vertical direction.

Figure 6:
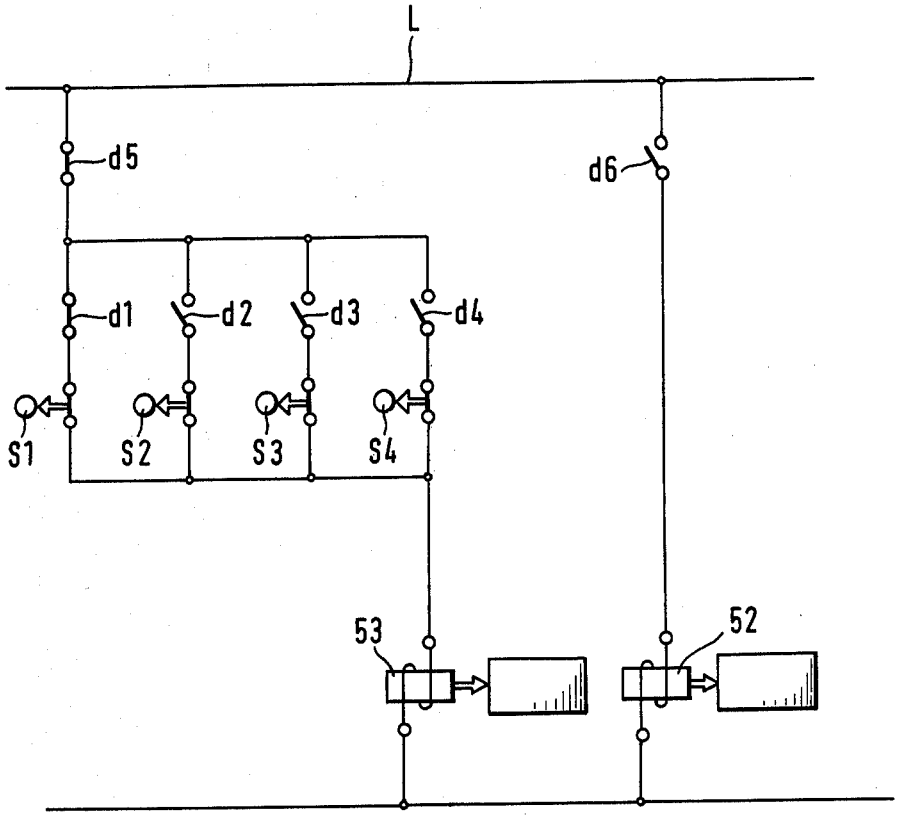
FIG. 6 is a schematic circuit diagram illustrating the switches and pneumatic valves for the device of FIG. 1.

As shown in FIG. 6, the electromagnet 53 of the magnetic valve 5 connects with the current conducting line L via the limit switches S1, S2, S3 and S4 as well as via contacts ***d*1, *d*2, *d*3, *d*4 and *d*5, and the electromagnet 52 connects with the current line L via a contact *d*6. The opening and closing of the contact *d*5 is effected by a switch S5 (FIG. 3) mounted on the carriage 1 and this switch is actuated by a cam (not shown) which is fixed to the swivel pin of the gripper arm 2. The contact *d*6 is actuated by switch SE. The triggering of the limit switches S1, S2, S3, and S4, acting as the limit means, by opening and closing contacts *d*1, *d*2, *d*3 and *d*4, is effected by the control device which determines the mixture ratio, which is available in various modifications. Thus, the carriage 1 may be equipped with switches which can be operated by cams located in the path of travel of the carriage, or the carriage 1 may carry lugs or cams which represent in miniature the path of travel of the carriage 1. It is also possible to operate these contacts by means of sensing members arranged in the collecting container and so to trigger the limit switches. In the present case, carriage 1 is provided with four switches SW (FIG. 1) which are operated by control cams arranged in the path of travel. FIG. 3 shows the control cams 6, 61 and 62 for the fiber supply points I, III and IV, while the control cam arranged in line with fiber supply point II is not visible. When the carriage 1 moves to the fiber supply point I, contact *d*1 is closed as a result of the action of cam 6 on its switch SW. When the carriage 1 enters fiber supply point II contact *d*2 is closed as a result of the action of the cam (not shown) in the area of the fiber supply point II upon its switch SW arranged on the carriage 1. Likewise, when the appropriate switch SW operates cam 61, the contact *d*3 is closed and contact *d*4 is closed when cam 62** is actuated.

There now follows a description of the operation of the device with reference to FIGS. 1 to 6. It is assumed that the fiber supply point I is required to supply only a small mixture ratio of 10% of the total mixture and the fiber supply points II, III and IV supply mixture ratios of 20%, 30% and 40%, so that progressively larger portions of the composition have to be taken from the individual fiber supply points in order to provide a composition which is small in quantity but at the same time contains a complete fiber mixture.

The carriage 1 is located in the position of the fiber supply point I, whereby the gripper arm 2 is arranged in the position shown in FIG. 1. Contact ***d*6 is open since chain 3 is under tension and the metal base plate 38 of housing 35 is thus located outside its effective area for the switch SE. In the area of the fiber supply point I the cam 6, located in the path of travel, acts upon the switch SW arranged on the carriage 1, thus closing contact *d*1. When switching on, the gripper arm 2 swings over the collecting container 16. This causes the cam arranged on the swivel axis of the gripper arm 2 to operate the switch S5 in its traversed position thereby closing contact *d*5 (FIG. 6). A current conducting connection is thus established between line L and the electromagnet 53 via contacts *d*5, *d*1 and the closed contact of the limit switch S1. The electromagnet 53 is excited causing compressed air to flow through pipes 54 and 51 into the cylinder 41 and to force down piston 40 with piston rod 4. This causes the gripper fingers 21 to swing about the axis 45 and to open. However, as soon as the control cam 46, which is fixed to the piston rod 4 and moves downwards with the same, actuates the limit switch S1 and opens its contact, the electromagnet 53 is de-energized. The magnetic valve 5 closes and the compressed air supply to cylinder 41 is interrupted. Thus, the opening width of the gripper fingers 21 in the fiber supply point I is determined by the limit switch S1 and the control cam 46 acting upon the switch S1. The setting of the limit switch S1 has the result that the opening of the gripper fingers 21 is limited to a small width corresponding to the small mixture ratio of 10% for the type of fiber of fiber supply position I and for taking from bales B1 to B5** small portions required for a mixture as accurate as possible.

When the device is switched on and the gripper arm 2 swings in and out, the carriage 1 travels to the next fiber bale of the fiber supply point I. The drive motor M is stopped and the piston of piston rod 33 (FIG. 1) is subjected to compressed air in such a way that the piston rod 33 is forced upwards and the gripper arm 2, with the gripper fingers 21 opened to a limited width by the limit switch S1 and control cam 46, is lowered onto the bale B1. When the gripper fingers 21 have penetrated the bale B1 to a predetermined depth and the chain 3 has lost its tension in relation to this depth of penetration, base plate 38 of the housing 35, which slides along the rod 37, now actuates switch SE (FIG. 2), closing contact *d6*. The action of closing contact *d6* has the effect that the electro-magnet 52 of the magnetic valve 5 becomes excited by the flow of current, thus causing compressed air to flow through pipes 54 and 50 and into the cylinder 41. The air forces piston 40 and piston rod 4 upwards while the air in the upper part of the cylinder 41 is passed into the atmosphere through pipes 51 and 55. The upwards motion of the piston rod 4 closes the gripper fingers 21. This also results in the disengagement of the limit switch S1 from the control cam 46 resulting in the switch closing.

The gripper arm 2 with the fiber material held by the gripper fingers 21 is now lifted from the bale B1 by the action of the piston rod 33 being forced down in the cylinder 34 by the compressed air. The chain 3 once again becomes tense so that the metal base plate 38 of housing 35 moves away from the switch SE and opens contact *d6*. Subsequently, the gripper arm 2 swings over the collecting container 16, whereby at the end of the swivel movement the cam, fixed to the swivel axis of the gripper arm 2, operates the switch S5 and contact *d5* is closed. This leads to the excitation of the electromagnet 53 and, thus, to the opening of the gripper fingers 21 in the manner described above, so that the fiber material taken from the bale I drops into the collecting container 16. Should this take-up operation fail to achieve the weight corresponding to the mixture ratio of 10%, fiber material is taken up from the next fiber bale or bales of the fiber supply point I. As soon as carriage I leaves the fiber supply point I, the contact *d1* is opened, since cam 6 now ceases to act upon the switch SW on carriage 1. Operation of the limit switch S1 by control cam 46 arranged on piston rod 4 therefore has no effect on the electromagnet 53 during the taking up of fiber material from subsequent fiber supply points.

The aforementioned process is repeated at the bales of fiber of the fiber supply points II, III and IV, with the one difference that the opening width of the gripper means 20 in relation to the fiber supply points is fixed and limited by a respective limit switch in accordance with the larger desired mixture ratios of, for example, 20%, 30% and 40% for the respective supply points II, III and IV. The pickup at supply point II is controlled by limit switch S2. The pickup at the fiber supply point III is controlled by the limit switch S3 and the takeup from the fiber supply point IV is controlled by the limit switch S4. The switches increase the proportions taken up in one operation by the gripper device 20 and match the size of the mixture ratio, so that the productivity of the takeup device in every case is utilized to the full, while at the same time maintaining the mixture ratio with great accuracy.

Figure 8:
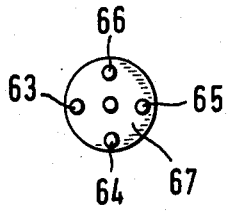
FIG. 8 is an enlarged plan view illustrating the limit stops of FIG. 7.
Figure 7:
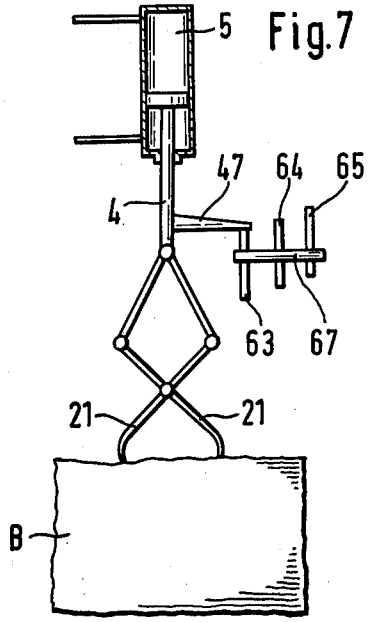
FIG. 7 is an enlarged diagrammatic view shown partially in section of a gripper device with alternate controls therefor.

In the embodiment illustrated in FIGS. 7 and 8 (in the place of limit switches) for fixing the opening width of the gripper device 20, there are provided limit stops 63, 64, 65 and 66 mounted on a turret head 67. By rotation of the turret head 67, one of the stops after another are placed in the path of a stop 47 which is secured to the piston rod 4 and thereby moved by the same. During the downward movement of the piston rod 4 in the direction towards the fiber bale B, the stop 47 abuts against the limit stop arranged in its path, thereby halting the further downward travel of the piston rod 4 and fixing the opening width of the gripper finger 21. The limit stops 63, 64, 65 and 66, one of which is provided for each fiber supply point, are adjustable in a vertical direction so that the opening width of the gripper fingers 12, and thus the partial quantity which is taken up from the fiber bales can be matched with the predetermined mixture quantities. The rotation of the turret head 67 is effected by a suitable drive, for example, an electric motor, which is also operated by the control device which determines the mixture ratios.

Figure 10:
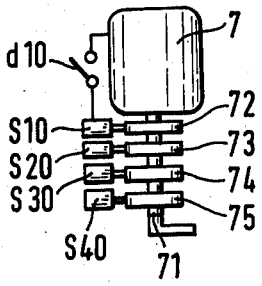
FIG. 10 is a plan view of the alternate embodiment illustrated in FIG. 9.
Figure 9:
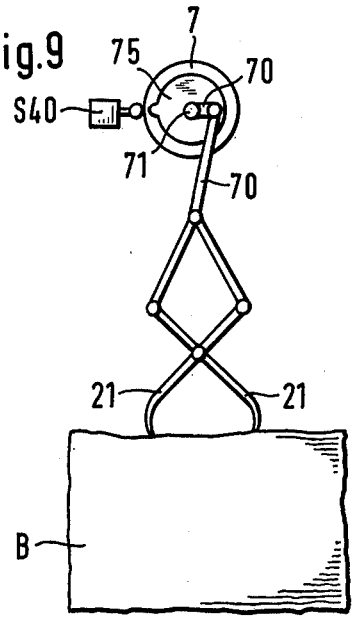
FIG. 9 is a diagrammatic alternate drive means for the gripper device with limit switches for limiting the opening width.

In FIG. 9, the opening and closing of the gripper fingers is effected by a reversible electric motor 7 with a crank 70. For setting different opening widths for the gripper fingers 21, there are provided limit means in the form of stationary limit switches S10, S20, S30 and S40 which are arranged near the motor shaft 71 and which extend parallel to it and which limit switches are operated by control cams (FIG. 10). The latter are in the form of cam discs 72, 73, 74 and 75 and displacably mounted on the motor shaft 71. The limit switches S10, S20, S30 and S40 and the electric motor 7 are electrically connected by a contact arranged between each two components. In the case of switch S10, this is indicated by a contact *d10*. These contacts correspond to contacts *d1* to *d4* in FIG. 6 and, like the same, are operated by the control device which determines the mixture ratios. By suitably adjusting the cam discs 72, 73, 74 and 75, it is possible to set the desired opening width of the gripper fingers 21 to correspond with the mixture ratio of the particular fiber supply point.

If the limit switch S40 is provided for the fiber supply point I with the smallest mixture ratio and if the cam disc 75 is so adjusted that its cam operates the limit switch S40 after only a quarter revolution of the crank 70 (FIG. 9), then after a quarter of a revolution, a control pulse is fed to the electric motor 7 halting the electric motor 7. This is because a contact which is located between limit switch S40 and electric motor 7 is closed as a result of the action by cam 6 (FIG. 3) which is located in the vicinity of the fiber supply point I, acting upon switch SW in carriage 1. The gripper fingers 21, therefore, are open only a small amount and for each operation take from the bales of fibers at the fiber supply point I only the small quantity required for the exact mixture ratio. The larger opening widths of the gripper fingers 21 in the fiber supply positions II, III and IV, corresponding to the larger mixture ratios of these fiber supply points, are fixed and limited by limit switches S30, S20 and S10 and the cam discs 74, 73 and 72. The limit switches and cam discs are acted upon at a correspondingly later point in time so that at each fiber supply point, there is achieved the best possible productivity from the device, while maintaining the mixture ratio.

Figure 11:
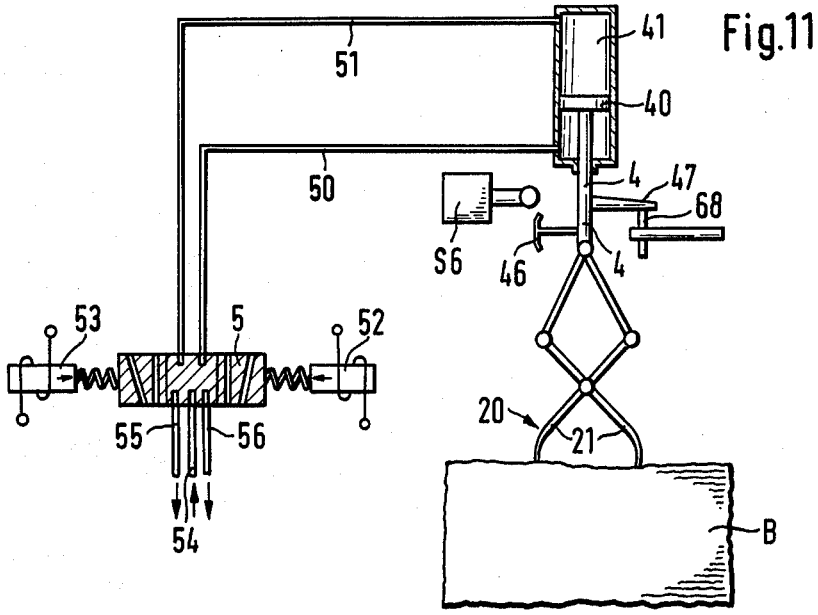
FIG. 11 is a diagrammatic view illustrating still another alternate form of the invention which includes mechanisms for fixing the opening of the grippers to two different positions.
Figure 12:
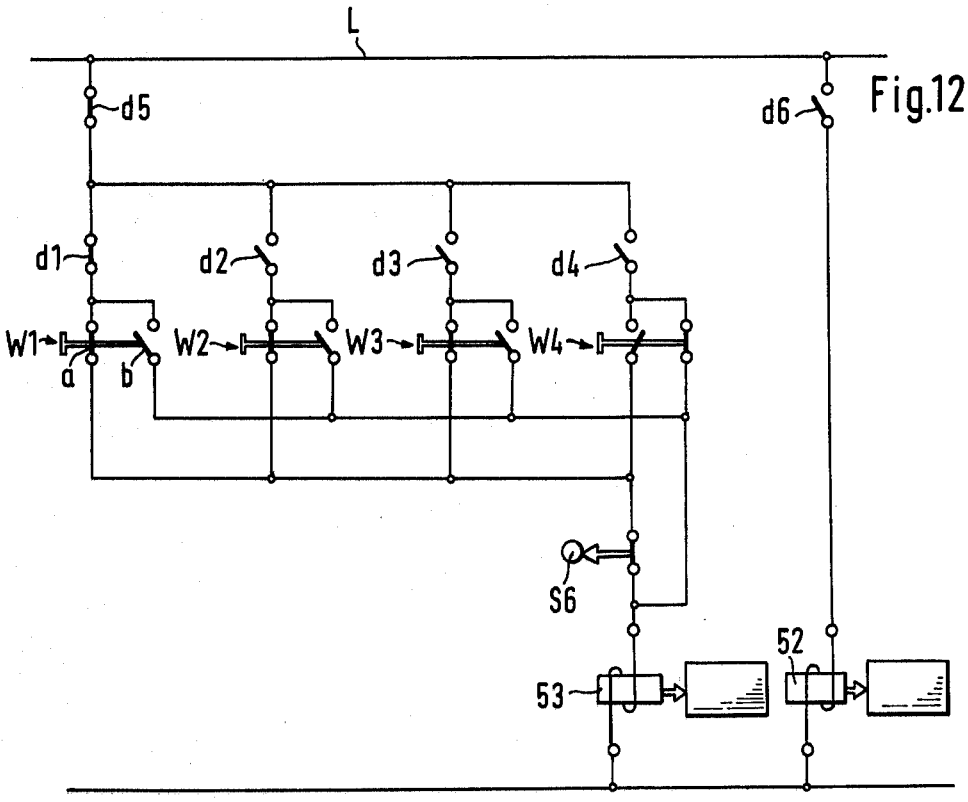
FIG. 12 is a schematic diagram illustrating the switching mechanism for a device such as illustrated in FIG. 11.

In the example of the embodiment according to FIG. 11, as well as FIG. 4, the drive means for opening and closing the gripper device 20 is provided by piston rod 4. The piston is driven in a cylinder 41 by compressed air which is regulated by the magnetic valve 5 with the electromagnets 52 and 53. The valve 5 selectively controls the flow of air through pipes 54, 50 and 54, 51 into the cylinder 41. However, here there are only two opening widths for the gripper fingers 21 for several types of fiber or fiber supply points. Two opening widths are sufficient when the mixture ratios of only two fiber supply points vary substantially and, where appropriate, the remainder are very similar. The first opening width, of the gripper fingers 21 which is smaller in relation to the second one, is fixed and limited by an adjustable limit switch S6 which is operated by the control cam 46 arranged on the piston rod 4. The second, larger opening width is fixed and limited by another adjustable limit switch 68 against which abuts the stop 47, mounted on the piston rod 4, in the course of the downward stroke of the piston rod 4. The current flow from line L to the electric magnet 52 takes place via contact *d*6, and to the electromagnet 53 via contacts *d*1, *d*2 . . . *d*5 as well as selector switches W1, W2, W3 and W4 and the limit switch S6 (FIG. 12). The contacts *d*1, *d*2 . . . *d*6 are identical with those shown in FIG. 6 and are operated in the same manner.

The limited opening width of the gripper fingers 21, caused by the limit switch S6 and control cam 46, for each particular fiber supply point is effected by the selector switches W1, W2, W3 and W4.

For example, when the carriage 1 is located in the fiber supply point I and the gripper device 20 is located above one of the fiber bales of this fiber supply point, so that the contacts *d*1 and *d*5 are closed, and when the selector switch W1 is located in the position as shown in FIG. 12, the electromagnet 53 is excited by the current flowing via contacts *d*5 and *d*1, the contact *a* of the selector switch W1 and the limit switch S6. Compressed air thus flows through the pipe 51 into cylinder 41, driving the piston rod 4 downwardly opening the gripper fingers 21. The opening movement is terminated as soon as the control cam 46 operates the limit switch S6 and opens its contact, thereby cutting off the current to the electromagnet 53 and the supply of compressed air.

If, on the other hand, by pressing the selector switch W1, the contact *a* is opened and contact *b* is closed, operation of the limit switch S6 does not affect the electromagnet 53 because the current now does not flow via the limit switch S6, but to the electromagnets 53 via the contacts *d*5 and *d*1 as well as *b*.

In this case, the opening width of the gripper fingers 21 is fixed and limited by the stop 47 and the limit stop 68. Depending on the size of the mixture ratio and thus the size of the portions to be taken from the supply points, it is, therefore, possible to select for the individual fiber supply points either the smaller or the larger opening width for the gripper fingers 21, so as to achieve high productivity with the device while at the same time maintaining a precise and set mixture ratio.

The invention can be applied to all devices for opening and mixing fiber bales with pincer-like grippers devices, irrespective of which side of the bales the fiber takeup takes place.

While a preferred embodiment of the invention has been described using specific terms, such description is for illustrative purposes only, and it is to be understood that changes and variations may be made without departing from the spirit or scope of the following claims.

What is claimed is:

1. A device for removing fibers according to predetermined mixture ratios with a pincer-like gripper device which picks off fibers from bales of different fibers and deposits said fibers at another location, said device comprising:

drive means for effecting the opening and closing of said pincer-like gripper device for removing fibers from said bales of different fibers;

means operably connected to said drive means for limiting the opening of said pincer-like gripper device to a first predetermined width for removing fibers constituting the smallest ratio of said desired mixture ratio when picking off fibers from one of said bales;

means operably connected to said drive means for limiting the opening of said pincer-like gripper device to a second predetermined width for removing fibers from another bale of different fibers constituting a larger ratio of said mixture ratio; and said second width of opening of said pincer-like gripper device being greater than said first width so that the individual pickoffs from the bale calling for a larger ratio is greater than the individual pickoff from said bale of said one type of fibers.

2. The device for opening and mixing fibers according to claim 1 wherein said drive means for effecting the opening of said pincer-like gripper includes:

a power driven member operably connected to said pincer-like gripper device, means for raising and lowering said power driven member for opening and closing said pincer-like gripper device, said means for limiting the opening of said pincer-like gripper device to a first predetermined width including, (i) first switch means carried in the path of said power driven member for stopping the opening of said pincer-like gripper device upon opening a predetermined width, said means for limiting the opening of said pincer-like gripper device to a second predetermined width including, (i) second switch means carried in the path of said power driven member for stopping the opening of said pincer-like gripper device upon opening a second predetermined width.

3. The device as set forth in claim 1 wherein said means for limiting to said first and second predetermined widths comprises a plurality of adjustably arranged cam discs, a plurality of limit switches positioned adjacent said cam discs, said drive means moving said cam discs when opening said pincer-like gripper into engagement with said limit switches, means for selectively enabling said switches, and said limit switches being operably connected to said drive means when enabled for stopping said drive means when closed by said cam discs.

4. The device as set forth in claim 1 wherein said drive means comprises:

(a) a movable member which moves in one direction for opening said pincer-like gripper and in another direction for closing said pincer-like gripper, and (b) said means for limiting the opening of said pincer-like gripper device to said first and second predetermined widths includes a plurality of switches being positioned in the path of said movable member for being sequentially engaged by said movable member.

5. The device as set forth in claim 4 wherein the number of switches correspond to the desired number of ratios making up said mixture ratio.

6. The device as set forth in claim 1 wherein said means for limiting the opening of said pincer-like gripper device includes an adjustable limit switch, and said means for limiting the opening of said pincer-like gripper device to a second predetermined width includes an adjustable limit stop.

7. A device for removing fibers according to a predetermined mixture ratio with a pincer-like gripper device, a carriage transporting said pincer-like gripper device past bales of different fibers, and, drive means provided for effecting the opening and closing of said pincer-like gripper device for removing the fibers from said bales of different fibers, the improvement comprising:

a plurality of switches operably connected to said drive means for limiting the width that said pincer-like gripper device is opened, each of said switches limiting the opening of said pincer-like gripper device to a different width so as to control the amount of fibers picker off the different bales, and means for selectively enabling said plurality of switches so as to selectively control the amount of fibers picked off said different bales in order to remove fibers from said different bales according to said desired ratios for making up said predetermined mixture ratio.

8. The device as set forth in claim 7 wherein said means for enabling said plurality of switches comprise:

selector switch means carried in the path of travel of said carriage generating a signal indicating the location of said carriage and gripper device relative to said bales of fibers.

9. The device as set forth in claim 8 wherein said selector switch means includes a plurality of enabling switches, each of said enabling switches being connected in series with a respective one of said plurality of switches which limit the width that said pincer-like gripper device is opened.

* * * * *